US008765347B2

(12) United States Patent
Nakamura et al.

(10) Patent No.: US 8,765,347 B2
(45) Date of Patent: Jul. 1, 2014

(54) TWO-COMPONENT DEVELOPING AGENT AND DEVELOPING METHOD

(71) Applicants: Kosuke Nakamura, Tokyo (JP); Okushi Okuyama, Tokyo (JP)

(72) Inventors: Kosuke Nakamura, Tokyo (JP); Okushi Okuyama, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/728,074

(22) Filed: Dec. 27, 2012

(65) Prior Publication Data

US 2013/0171559 A1 Jul. 4, 2013

(30) Foreign Application Priority Data

Dec. 28, 2011 (JP) ..... 2011-287318

(51) Int. Cl.
*G03G 9/113* (2006.01)

(52) U.S. Cl.
CPC ..... *G03G 9/1131* (2013.01); *G03G 9/1139* (2013.01)
USPC ..... 430/111.33; 430/111.32; 430/111.35

(58) Field of Classification Search
CPC ..... G03G 9/1131; G03G 9/1139
USPC ..... 430/111.33, 111.32, 111.35
See application file for complete search history.

(56) References Cited

FOREIGN PATENT DOCUMENTS

| | | |
|---|---|---|
| JP | 2007-133100 | 5/2007 |
| JP | 2008-065060 | 3/2008 |
| JP | 2010-250281 | 11/2010 |
| JP | 2011145497 | 7/2011 |
| JP | 2011-164230 | 8/2011 |
| JP | 2011164230 | 8/2011 |
| JP | 2012-083389 | 4/2012 |

OTHER PUBLICATIONS

Japanese Office Action, Notification of Reasons for Refusal, Patent Application No. 2011-287318. Dispatch date: Jan. 28, 2014 (4 pages).

English translation of Japanese Office Action, Notification of Reasons for Refusal, Patent Application No. 2011-287318. Dispatch date: Jan. 28, 2014 (5 pages).

*Primary Examiner* — Mark A Chapman
(74) *Attorney, Agent, or Firm* — Lucas & Mercanti, LLP

(57) ABSTRACT

A two-component developing agent includes toner and a carrier including carrier particles. The toner includes a binding resin. The carrier particle includes a porous ferrite core particle and a resin covering layer. The resin covering layer covers the porous ferrite core particle. The resin covering layer includes ferrite particles. An average particle diameter of the ferrite particles ranges from 0.1 to 1.0 μm.

16 Claims, 3 Drawing Sheets

TWO-COMPONENT DEVELOPING AGENT AND DEVELOPING METHOD

BACKGROUND OF THE INVENTION

1. Field of the Invention

The present invention relates to a two-component developing agent and a developing method.

2. Description of Related Art

In recent years, performance of an image forming apparatus, especially a color image forming apparatus, has become faster. Accordingly, a problem has been raised that an agitation intensity has become bigger to increase agitation stress to a developing agent in a developing unit, which results in deterioration of toner.

To solve the problem, a specific gravity of a carrier constituted of carrier particles has been lowered, and a magnetic material-dispersed carrier has been proposed, for example. However, in some types of such carriers, carrier particles are easily crushed or deformed when receiving impact.

Meanwhile, there have been studies of decreasing white splotches resulted from an edge effect by putting conductive fine particles in a resin covering layer of a carrier particle to control an electric resistance of the carrier and enhance developability. For example as disclosed in Japanese Patent Laid-Open Publication No. 2011-145497, it has been commonly performed to put carbon black in a resin covering layer of a carrier to raise an electric resistance of the carrier and enhance developability. However, when such a resin covering layer is abraded or exfoliated, resin powder is obtained. The resin powder is colored by carbon black and hence stains images.

In addition, as disclosed in Japanese Patent Laid-Open Publication No. 2011-164230, there also have been studies of decreasing white splotches by putting magnetite in a resin covering layer of a carrier particle. However, magnetite has a high residual magnetization, and thus decreases a fluidity of the carrier.

SUMMARY OF THE INVENTION

The present invention has been made in consideration of the above-described problems. To solve the above problems, objects of the present invention include providing a two-component developing agent and a developing method, each of which can reduce agitation stress to toner by lowering a specific gravity of the carrier, increase a transfer rate, reduce an edge effect, which is derived according to a degree of developability, and further, avoid stains in images and density unevenness in images, which is caused by a decreased fluidity, to stably provide high quality images having carrier particles as few as possible.

According to an aspect of the present invention, there is provided a two-component developing agent including toner including a binding resin, and a carrier including carrier particles, each of which includes a porous ferrite core particle and a resin covering layer which covers the surface of the porous ferrite core particle; the resin covering layer includes ferrite particles, and an average particle diameter of the ferrite particles ranges from 0.1 to 1.0 μm.

According to another aspect of the present invention, there is provided a developing method includes performing development with the two-component developing agent as defined above so as to supply the toner and the carrier together.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, wherein.

DESCRIPTION OF THE PREFERRED EMBODIMENTS

The present invention, and elements and embodiments thereof are described below in detail.

Here, in the present application, a plurality of ranges of values are described. Each of the ranges is described with "from A to B". A and B are numeral values, and represent the minimum and the maximum values of each range, respectively.

[Two-Component Developing Agent]

A two-component developing agent of the present invention contains toner including a biding resin and a carrier including carrier particles, each of which includes a porous ferrite core particle and a resin covering layer which covers the porous ferrite core particle. The resin covering layer includes ferrite particles and an average particle diameter of the ferrite particles ranges from 0.1 to 1.0 μm.

<Carrier>

The carrier of the present invention is constituted of the carrier particles, each of which includes the porous ferrite core particle and the resin covering layer which covers the porous ferrite core particle and includes the ferrite particles.

The porous ferrite core particle of the present invention is a particle having fine pores on the surface and inside thereof The resin covering layer of the present invention is a layer provided on the surface of the porous ferrite core particle. The resin covering layer is constituted of a resin and the resin may be partly included inside the porous ferrite core particle.

Preferably, a bulk density of the carrier particles of the present invention ranges from 1.1 to 2.0 g/cm$^3$, and more preferably from 1.3 to 1.8 g/cm$^3$. By keeping the bulk density of the carrier particles in the above value range, a specific gravity of the carrier is lowered enough, and the carrier particles of the present invention have an adequate mechanical strength, so that the carrier particles are not broken when receiving impact by agitation in the developing unit. Thus, the above value range is preferable for providing the carrier particle with a long-life span with a lighter weight thereof.

In the present invention, the bulk densities of the porous ferrite core particles and the carrier particles can be measured according to JIS-Z-2504 as follows.

Figure 1:
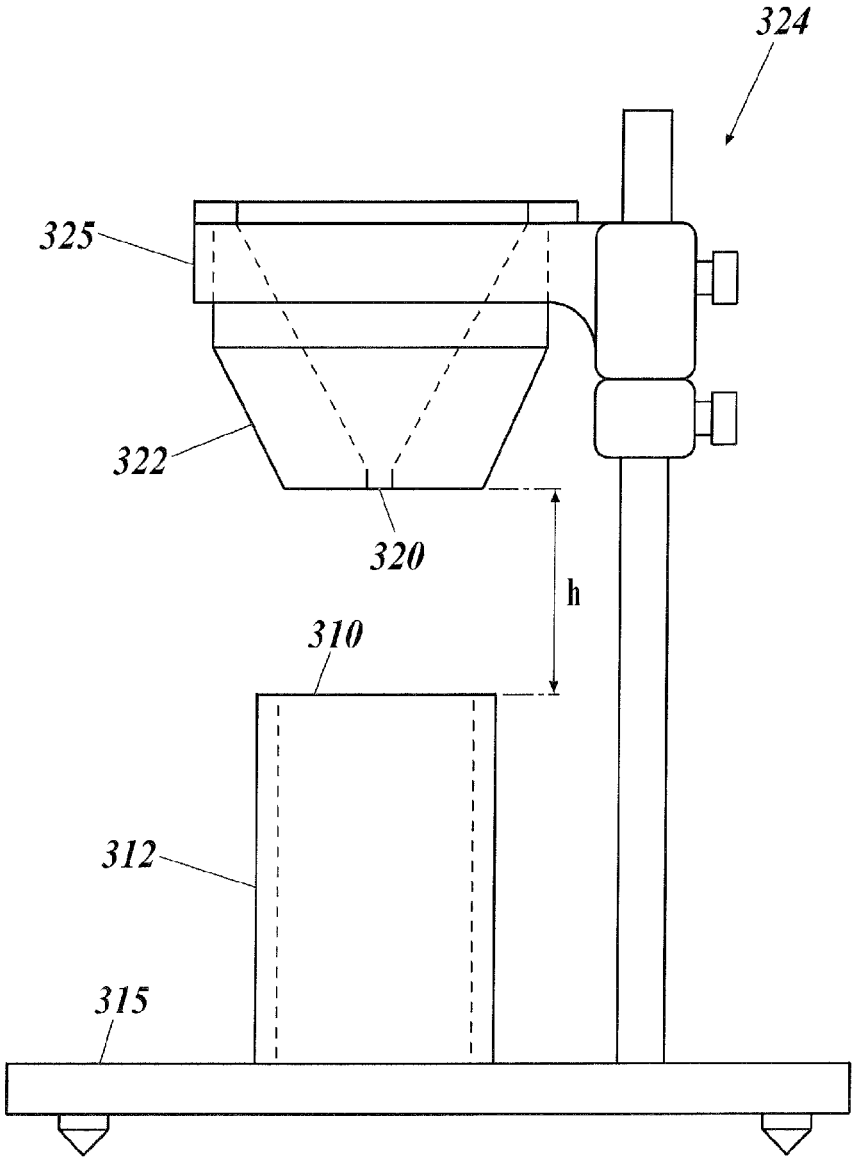
FIG. 1 is a diagram illustrating a device for measuring bulk densities of porous ferrite core particles and carrier particles.

FIG. 1 is a diagram illustrating an example of a device for measuring the bulk densities of the core particles and the porous ferrite carrier particles.

The device illustrated in FIG. 1 is configured as follows. A cylindrical container 312 which has at the upper edge thereof an opening 310, which is in a circular shape and has a diameter of 28 mm, and has a volume of 25 cm$^3$. The cylindrical container 312 which is positioned on a container bedplate 315 arranged on a horizontal plane. The container bedplate 315 with which a stand 324 is equipped, and the stand 324 has a funnel holder 325. The funnel holder 325 holds a funnel 322, which has at the bottom end thereof an outlet 320 having a diameter of 2.5 mm, right above the cylindrical container 312 at a height (h) of 25 mm from a level of the opening 310 to a level of the outlet 320. Sample is let out and dropped from the outlet 320 of the funnel 322 to be let flow into the cylindrical container 312 until the sample overflows the opening 310. Then the sample that exists higher than the level of the opening 310 of the cylindrical container 312 is discarded by leveling off the sample at the level of the opening 310. Thereafter, a weight of the sample filling the cylindrical container 312 is measured, and the measured value is used for calculating a bulk density A ($g/cm^3$) of the sample with the following equation.

$A$=[weight of the sample filling the cylindrical container (g)]/[volume of the cylindrical container ($cm^3$)]

The carrier particle of the present invention preferably has a volume-based median pore diameter ($D_{50}$) ranging from 15 to 80 μm, and more preferably from 20 to 60 μm. By keeping the volume-based median pore diameter of the carrier in the above value ranges, high quality toner images can be stably formed. The volume-based median pore diameters of the core particle and the carrier particle can be measured with a laser diffraction particle size analyzer with which a wet disperser is equipped; "HELOS (Sympatec GmbH)".

An average layer thickness of the resin covering layer ranges preferably from 0.05 to 4.0 μm, and more preferably from 0.2 to 3.0 μm to provide the carrier with both durability (mechanical strength) and a low electric resistance.

The average layer thickness of the resin covering layer can be calculated by the following method.

Thin slices of the carrier particles are prepared with a focused ion beam sample preparation device ("SMI2050", SII NanoTechnology Inc.), and then the thin slices are observed with a transmission electron microscope ("JEM-2010F", JEOL Ltd.) with 5,000-fold magnification. Thereafter, thicknesses of the thickest and the thinnest parts of the resin covering layers observed with this magnification are averaged to obtain the average layer thickness of the resin covering layer.

Preferably, an electric resistance value of the carrier of the present invention ranges from $10^7$ to $10^{12}$ Ω·cm, and more preferably from $10^8$ to $10^{11}$ Ω·cm. By keeping the electric resistance of the carrier in the above value ranges, the carrier becomes optimum to obtain high-concentration toner images.

In addition, the carrier of the present invention has a saturation magnetization ranging preferably from 30 to 80 $Am^2/kg$, and a residual magnetization thereof is preferably 5.0 Am/kg or less. The carrier having the above-defined magnetic properties prevents some of the carrier particles from aggregating. Thus, the two-component developing agent is evenly dispersed on a developing agent conveying unit. Accordingly, development capable of forming an even and fine toner image which does not have density unevenness is performed.

The magnetic property of the carrier can be measured with a supersensitive vibrating sample magnetometer ("VSM-P7-15", TOEI INDUSTRY CO., LTD.) setting a magnetic field to be measured to 5 KOe and submitting 25 mg of a sample.

The residual magnetization can be reduced by using ferrite. When the residual magnetization is small, the carrier has an excellent fluidity, and thus the two-component developing agent having an even bulk density can be obtained.

<Porous Ferrite Core Particle>

Figure 2:
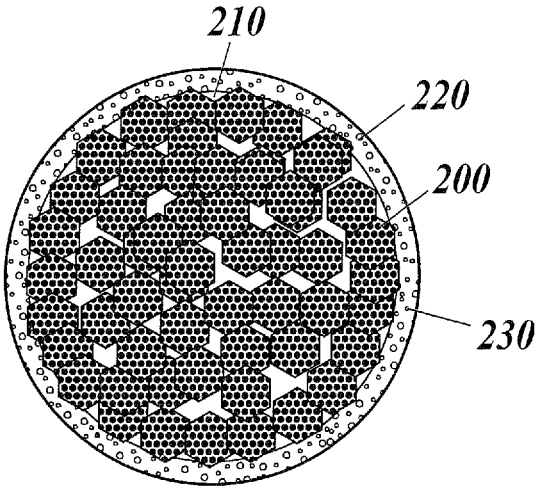
FIG. 2 is a schematic cross-section diagram of the carrier particle prepared using the porous ferrite core particle.

FIG. 2 is a schematic diagram illustrating a cross-section view of the carrier particle prepared using the porous ferrite core particle.

In FIG. 2, "200" indicates the porous ferrite core particle, "210" indicates the fine pores, "220" indicates the resin covering layer, and "230" indicates ferrite particles in the resin covering layer.

Preferably, in the carrier of the present invention, a fine pore diameter of the fine fore of the porous ferrite core particle of the carrier particle ranges from 0.2 to 0.7 μm. By keeping the fine pore diameter in the above value range, a specific gravity of the carrier can be reduced and the resin which covers the porous ferrite core particle can avoid entering into the fine pores. Thus, the even resin covering layer can be formed, and thus an excellent fluidity of the carrier can be achieved.

The fine pore diameter of the fine pore of the core particle can be measured by, for example, the mercury intrusion method (the mercury porosimetry) with a mercury porosimeter. The mercury intrusion method (the mercury porosimetry) is a method for obtaining fine pore diameters by ways of: applying pressure to mercury, which does not react with almost all substances and does not leak, to make mercury intrude into fine pores of a solid material; and calculating a relationship between the applied pressure and a volume of mercury which has intruded into the fine pores. More specifically, a sample cell filled with mercury is put in a high-pressure container, and inside of the container is gradually pressurized. Then, mercury is pressed to intrude into bigger pores first, and then into smaller pores. Accordingly, the fine pore diameters can be obtained based on the volume of mercury which has intruded into the fine pores.

The relationship between the pressure applied to mercury for mercury intrusion and the volume of mercury which has intruded into the fine pores by the applied pressure is obtained with the Washburn's equation described below.

$$D=-4\gamma\cos\theta/P$$

In the above equation, "P" represents the applied pressure, "D" represents the fine pore diameter, "γ" represents the surface tension of mercury, and "θ" represents a contact angle of mercury with the wall of the fine pore. Since "γ" and "θ" are constants, the relationship between the applied pressure P and the fine pore diameter D is calculated with the above equation. Then, the volume of mercury which has intruded into the fine pores by the applied pressure is measured. Thereafter, a relationship between the fine pore diameter and a volume distribution of the fine pores is obtained.

The fine pore diameter of the fine pore of the core particle of the present invention can be measured with, for example, commercially available porosimetries, such as both of "Pascal 140" and "Pascal 240" (Thermo Fisher Scientific Inc.). A method using "Pascal 140" and "Pascal 240" is performed in the sequence of:

(1) introducing a sample to be measured into a commercially-available gelatinous capsule having a plurality of pores thereon, and putting the capsule in the dilatometer for powder, "CD3P";
(2) performing deaeration with "Pascal 140", filling the dilatometer with mercury, and performing a measurement under a low pressure (from 0 to 400 kPa) (First Run);
(3) after the First Run, performing again the above deaeration and the measurement under the above-defined low pressure (Second Run);
(4) after the Second Run, measuring a total weight of the dilatometer, mercury, the capsule, and the sample;
(5) performing a measurement with "Pascal 240" under a high pressure (from 0.1 to 200 MPa) and using a measured volume of mercury which has intruded into the fine pores under the above high pressure to obtain a volume of the fine pores of the core particle, a distribution of the fine pore diameters, and the peak value of the fine pore diameters of the fine pores of the core particle.

In the above, defining that the surface tension of mercury is 480 dyn/cm and the contact angle is 141.3°, the volume of the fine pores of the core particle, the distribution of the fine pore diameters of the core particle, and the peak value of the fine pore diameter of the core particles are calculated, and the peak value of the fine pore diameter is determined as the fine pore diameter.

Ferrite constituting the porous ferrite core particle is a compound represented by the formula: (MO), $(Fe_2O_3)_y$. The molar ratio y of $Fe_4O_3$ of ferrite ranges preferably from 30 to 95 mol %. Ferrite particles having the above molar ratio provides a desirable magnetic property, and it is preferable to prepare carriers having a excellent delivery property. In the above formula, "M" can be, except for Fe, a metal atom such as manganese (Mn), magnesium (Mg), strontium (Sr), calcium (Ca), Titan (Ti), copper (Cu), zinc (Zn), nickel (Ni), aluminum (Al), silicone (Si), zirconium (Zr), bismuth (Bi), cobalt (Co), or lithium (Li), or combinations thereof.

<<Preparation of Porous Ferrite Core Particle>>

The core particle of the present invention can be prepared by known methods, for example, can be prepared by steps described in the following Examples. Hereafter, exemplary methods of preparing the core particle of the present invention are described. However, a method of preparing the core particle of the present invention is not limited to the following methods.

(1) Ingredients milling step

In this step, after weighing proper amount of ingredients of the core particle, weighted ingredients are put into a ball mill, a vibration mill, or the like for a dry milling step. This dry milling step is to be performed for 0.5 hour or more, and preferably for 1 to 20 hours. By adjusting kinds of ingredients and a milling degree in this step, a void ratio, fine pore diameters, a volume of the fine pores, and a bulk density of the core particles can be controlled.

In addition, for preparing the core particles represented in the above formula $(MO)_x(Fe_2O_3)_y$, the ingredients preferred are hydroxides or carbonates which are usable for preparing a metal oxide represented in the above formula. Core particles constituted of hydroxides or carbonates as ingredients are preferable because such particles have a higher void ratio and continuous void than a void ratio and continuous void of core particles constituted of oxides as ingredients.

(2) Pellet Forming Step

In this step, the milled products (ingredients) prepared in the above milling step are formed into, for example, 1 mm square-sized pellets with a pressure forming device or the like. The formed pellets are screened with a screen having a predetermined aperture so as to sort out coarse or fine particles, which are obtained with the formed pellets after the pellet forming.

(3) Calcinating Step

In this step, the formed pellets are put and kept in a commercially available electric oven for several hours as a heating step. A heating temperature preferably ranges from 700 to 1200° C. By adjusting a heating temperature and a heating time in this step, a void ratio, diameters of the fine pores, a volume of the fine pores, and a bulk density of the core particles can be controlled.

Here, the above calcinating step is not essential for the core particles of the present invention. The core particles of the present invention can be prepared by a wet milling step without a calcinating step followed by the steps described below, i.e., a pellet forming step and a firing step, and the like. Core particles prepared without a calcinating step tend to have a high void ratio and a high continuous void. In this respect, when porous core particles are prepared, a relatively low heating temperature is preferred in the calcinating step.

(4) Calcinated Product Milling Step

In this step, the pellets calcinated in the above calcinating step (calcinated products) are milled in dry condition with a ball mill, a vibration mill, or the like as a dry milling step.

Here, when a dry milling is performed, beads to be used as media have diameter preferably 1 mm or less. Accordingly, the ingredients and the pellets can be more surely dispersed evenly and effectively. In addition, by adjusting a diameter of the beads, a composition of the beads, and a milling time, a milling degree of the ingredients or the pellets can be controlled.

(5) Wet Milling Step

In this step, water is added to the milled products prepared in the above milling step and wet milling is performed with a wet ball mill or a vibration mill to produce slurry dispersing the milled products having a desired diameter therein. By adjusting diameters of the milled products in the slurry in this step, the fine pore diameters of the core particle can be controlled.

In addition, by adjusting water amount to be added when preparing the slurry, a void ratio, diameters of the fine pores, a volume of the fine pores, and a bulk density of the core particles can be controlled. When an added amount of water is larger, more voids are created. Accordingly, larger water amount is preferable to form core particles having a high void ratio and a low bulk density.

(6) Particle Forming Step

In this step, a dispersion or a binder such as poly vinyl alcohol (PVA) is added to the slurry prepared in the above wet milling step to adjust a viscosity of the slurry. Particles are formed from the slurry and the formed particles are dried with a spray dryer. By adjusting an amount of a binder or water, or a drying degree in this step, a void ratio, diameters of the fine pores, a volume of fine pores, and a bulk density of the core particles can be controlled.

(7) Firing Step

After drying the above formed particles in the above particle forming step, in this step, the dried particles are put into a heating device such as an electric oven, and heated at a temperature ranging from 800 to 1400° C. for from 1 to 24 hours while an oxygen concentration is controlled by supplying nitrogen gas or the like to the heating device, to prepare fired products. By adjusting a way of firing, a heating temperature (a firing temperature), a heating time (a firing time), a supplying amount of nitrogen gas, and a degree of generation of reducing atmosphere by hydrogen gas in this step, a void ratio, diameters of the fine pores, a volume of the fine pores, and a bulk density of the core particles can be controlled.

A heating device for the firing step can be a commonly known electric oven which can perform a firing process under air atmosphere, nitrogen gas atmosphere or reducing atmosphere which is generated by supplying hydrogen gas. For example, a rotary type electric oven, a butch type electric oven, or a tunnel type electric oven can be used.

(8) Cracking and Classifying Step

In this step, the fired products prepared in the above firing step is cracked and classified to prepare core particles having a predetermined diameter. In this classification, a commonly known classifying method can be used. For example, a wind classification, a mesh filtration, a precipitation or the like can be used to adjust diameters of the fired products to be a desirable diameter.

In addition, after the cracking and classifying step, as described in the following Examples, a commonly known electromagnetic separator can be used to pick up core particles having a weaker magnetic force among the core particles. The electromagnetic separator is used for finding out the core particles which have a higher electric force among the core particles with a magnet. For example, there are produced a bar magnet and a electromagnetic separator by Nippon Magnetics Inc.

The core particles of the present invention can be prepared by the above steps. Here, if necessary, a step for forming an oxide covering layer on the surface of the core particle by heating (an oxide covering layer forming step) can be performed. The oxide layer forming step can be performed by heating at a heating temperature ranging from 300 to 700° C. with the above-described commonly known electric oven like a rotary type electric oven or a butch type electric oven. In addition, before the oxide covering layer forming step, a reducing step can be performed. A layer thickness of the oxide covering layer preferably ranges from 0.1 nm to 5.0 μm. By using the carrier prepared with the core particles having the oxide covering layers kept in the above range, the carrier supplies electric charge to the toner stably and enough for a long time and so on. Thus, the core particles can stably keep a moderate electric conductivity.

<Resin Covering Layer>

The resin covering layer of the present invention contains the ferrite particles, and the ferrite particle diameter ranges from 0.1 to 1.0 μm. Preferably, the ferrite particle diameter ranges from 0.2 to 0.8 μm. Here, the reason why the ferrite particle diameter is determined as ranging from 0.1 to 1.0 μm is that, if the diameter is less than 0.1 μm, no magnetic force is generated and images are stained, and if the diameter is more than 1.0 μm, the ferrite particle is easy to remove from the resin covering layer.

The ferrite particles are contained preferably in the range from 0.01 to 1 part by weight, and more preferably from 0.1 to 0.8 part by weight, to the porous ferrite core particles.

The ferrite particles can be prepared by finely milling the above-mentioned porous ferrite core particle (s). A device for the fine milling can be, for example, a ball mill, a vibration mill, or the like. Here, to obtain an average diameter of the ferrite particles, a photo of the ferrite particles is taken with 5,000 magnification with a scanning electron microscope "JSM-7410" (JEOL Ltd.), and maximum lengths of 200 particles (the longest distance between any points on the periphery of the particle) are measured, and then a number average value of the maximum lengths is calculated as an average particle diameter. Here, if the particles are photographed in aggregate form, diameters of primary particles of the aggregates are measured.

A resin used for the resin covering layer can be, for example, a polyolefin resin such as polyethylene, polypropylene, chlorinated polyethylene, or chlorosulfonated polyethylene; polystyrene resins; an acrylic resin such as polymethyl methacrilate; a polyvinyl or polyvinylidene resin such as polyacrylonitrile, polyvinyl acetate, polyvinyl alcohol, polyvinyl butyral, polyvinyl chloride, polyvinyl carbazole, polyvinyl ether, or polyvinyl ketone; a copolymer resin such as vinyl chloride-vinyl acetate copolymer or stylene-acrylic acid copolymer; a silicone resin composed by organo siloxane bond or a modified resin thereof (modified with, for example, alkyd resin, polyester resin, epoxy resin or polyurethane); a fluorinated resin such as polytetrachloroethylene, polyvinyl fluoride, polyvinylidene fluoride or polychlorotrifluoroethylene; a polyamid resin; a polyester resin; a polycarbonate resin; an amino resin such as urea formaldehyde resin.

Among the above-mentioned resins, acrylic resins are preferred since acrylic resins well adhere to the core particles, and firmly stick to the core particles once receiving mechanical impact and/or heat, so that the covering layer is easily formed.

An acrylic resin can be a polymer composed of a chain methacrylic ester monomer such as methyl methacrylate, ethyl methacrylate, propyl methacrylate, n-butyl methacrylate, hexyl methacrylate, octyl methacrylate, or 2-ethylhexyl methacrylate, a polymer of an alicyclic methacrylic ester monomer having a cycloalkyl of from three to seven carbons such as cyclopropyl methacrylate, cyclobutyl methacrylate, cyclopentyl methacrylate, cyclohexyl methacrilate, cyclopentyl methacrylate, or the like.

A preferable resin among acrylic resins is a copolymer of alicyclic methacrylate ester monomer and a chain methacrylate ester monomer, to achieve both abrasion resistance and electric resistance.

A copolymerization proportion of the chain methacrylate ester monomer in the copolymer ranges from 10 to 70% by weight.

Another copolymer can be used, which is made of the above-mentioned acrylic resin and styrene monomer such as styrene, α-methystyrene or para-chlorostyrene.

A glass transition temperature of the resin ranges preferably from 40 to 140° C., and more preferably from 60 to 130° C.

The glass transition temperature of the resin is measured with "Diamond Differential scanning calorimetry (Diamond DSC)" (PerkinElmer Inc.).

The glass transition temperature is measured as follows. First, 3.0 mg of a sample (a resin) is contained in an aluminum pan, and then the sample-containing aluminum pan is set on a holder of "Diamond DSC". A vacant aluminum pan is used as a reference. Measurement is performed at a measuring temperature ranging from 0 to 200° C., at 10° C. of a temperature increase rate per minute, at 10° C. of a decrease rate per minute, under a temperature control of Heat-Cool-Heat. Data obtained in the second Heat is used for analysis.

The glass transition temperature corresponds to an intersection point of an extended line from a point of a base line just before a rising phase of a first heat sink peak and a tangential line having a maximum gradient between the rising phase of the first heat sink peak and the top of the peak.

A weight-average molecular weight of the resin ranges preferably from 100,000 to 900,000 Da, and more preferably from 250,000 to 750,000 Da.

The weight-average molecular weight of the resin is measured by performing a Gel Permeation Chromatograph (GPC) on tetrahydrofurane soluble fractions.

In detail, "HLC-8220" (Tosoh Corporation) and "TSK guard column+TSK-Gel Super HZM-M triplet" (Tosoh Corporation) are used as a measuring devise and a column, respectively. Tetrahydrofran (THF) as a carrier solvent is let flow through the column at a flow velocity of 0.2 ml/min keeping a column temperature 40° C., and the sample is dissolved into THF to be 50 mg/ml with an ultrasonic disperser at a room temperature for 5 minutes. Next, the sample is treated with a membrane filter having a pore size of 0.2 μm to obtain a sample solution. Then, 10 μl of this sample solution is injected into the device along with the above-mentioned carrier solvent, and detects the sample with a refractive index detector (RI detector). Thereafter, a molecular weight distribution of the sample is calculated referring to a standard curve obtained based on a measurement of monodisperse standard polystylene particles. As the standard polystylene samples, used are the samples made by Pressure Chemical Inc. having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, 4.48×

$10^6$, and at least around 10 standard polystylene samples are measured for obtaining the standard curve. Detecting the standard samples is performed with a refractive index detector (RI detector).

<<Forming Resin Covering Layer>>

As a method of forming the resin covering layer on the surface of the core particle, a dry coating method and a wet coating method are available. The dry coating method is preferred because the dry coating method can form a resin covering layer that does not enter into fine pores of a core particle and thus can prepare a carrier having a low bulk density.

(Dry Coating Method)

The dry coating method is for coating the core particle with the resin by mechanical impact or heat. The resin covering layer is formed by the following steps of:

1: agitating mechanically a coating material which disperses therein particles of the resin and the ferrite particles which are used for coating the surface of the core particles, and solid materials as an additive (for example, inorganic particles) if needed, along with the core particle, to attach the coating material on the surface of the core particles;

2: applying mechanical impact or heat to the resin particles and the ferrite particles in the coating material attached on the surface of the core particles to melt or soften the resin particles and the ferrite particles so as to fix the resin particles and the ferrite particles on the surface of the core particles, to form the resin covering layer; and 3: repeating the steps 1 and 2 as needed to obtain desired thicknesses of the resin covering layer.

A device for applying mechanical impact or heat to the coating material for coating the core particles can be a mill or a propeller agitation type high-speed blending machine equipping rotors and liners, such as "TURBO MILL" (TURBO Co. Ltd.), a pin mill, or "KRYPTRON" (Kawasaki Heavy Industries. Ltd.). Especially, a propeller agitation type high-speed blending machine is preferred because it can excellently form the resin covering layer.

When heating is performed, a heating temperature ranges preferably from 60 to 145° C. By keeping a heating temperature in the above value range, the core particles coated with a resin can be prevented from aggregating. Thus, the resin can be fixed on the surface of the core particles.

(Wet Coating Method)

(1) Fluidized Bed-Type Spray Coating Method

The fluidized bed-type spray coating method (or named as the solvent coating method) is for forming the resin covering layer, by spraying a coating solution where ferrite particles are dispersed in a solution including a solvent dissolving a resin, on the surface of the core particles with a fluidized bed-type spray coating device, and then drying the core particles.

(2) Dip Coating Method

The dip coating method is for forming the resin covering layer, by dipping the core particles to be coated in a coating solution where ferrite particles are dispersed in a solution including a solvent dissolving a resin, and then drying the core particles.

(3) Polymerization Method

The polymerization method is for forming the resin covering layer, by dipping the core particles to be coated in a coating solution where ferrite particles are dispersed in a solution including a solvent dissolving a reactive compound to apply the coating material to the core particles, and producing a polymerization reaction by heating or the like.

In the present invention to form the resin covering layer, the wet coating method, the dry coating method, or a combination thereof are available.

<Toner>

The toner of the present invention is prepared preferably by attaching an external additive on toner base particles to improve a fluidity, a transfer property, and a cleaning property of the two-component developing agent D.

The toner of the present invention has a volume-based median pore diameter ($D_{50}$) preferably ranging from 3.0 to 8.0 μm.

The volume-based median pore diameter ($D_{50}$) is obtained by measuring volume of the toner whose diameters ranges from 2.0 to 60 μm at an aperture diameter of 100 μm with "Multisizer 3" (Beckman Coulter, Inc.).

[Developing Method]

The developing method of the present invention is performed using the above-described two-component developing agent so as to supply the toner along with the carrier. This system is called as the Auto Refining Developing System, in which toner is supplied as toner is consumed in developing and a carrier is supplied together to gradually replace the carrier in a developing unit with a new carrier to suppress change in an electric charge amount and to stabilize a development density.

Hereinafter, a developing unit and a developing method for the Auto Refining Developing System is described.

Figure 3:
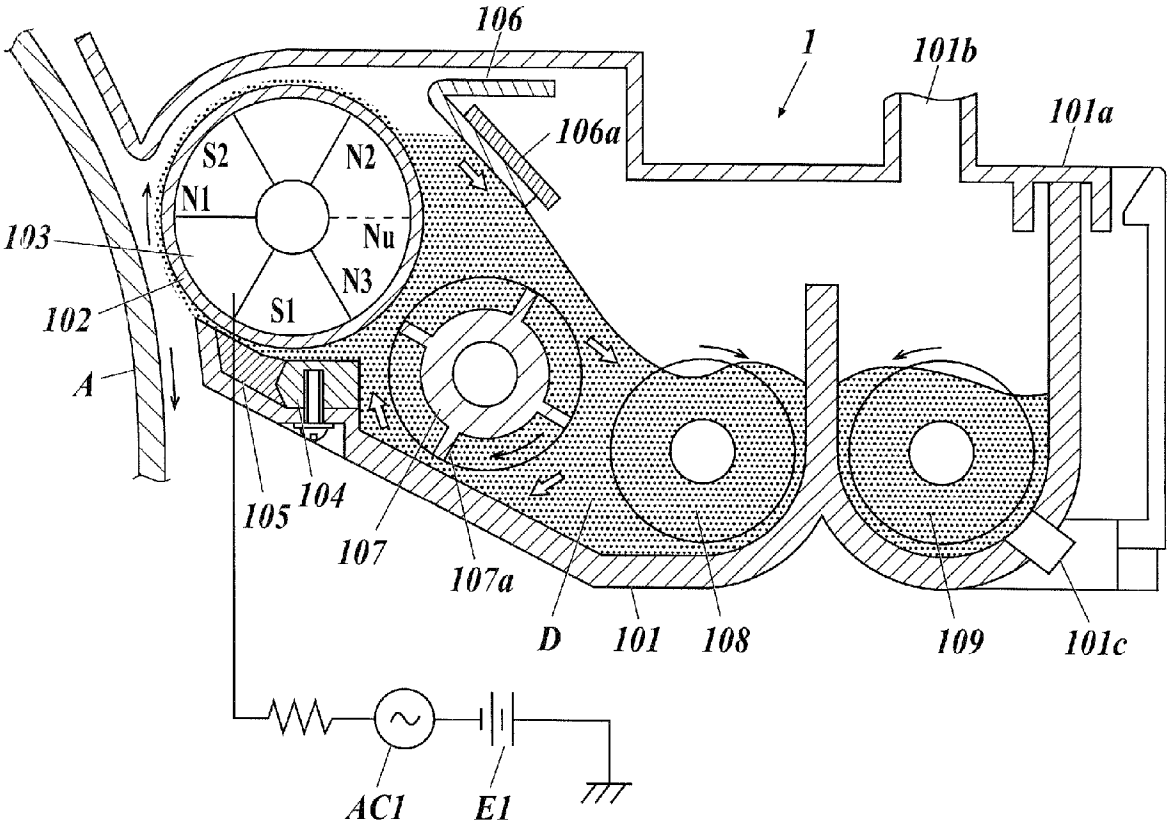
FIG. 3 is a magnified schematic cross-section diagram of a developing unit using the Auto-Refining Developing System.

FIG. 3 is a magnified schematic cross-section diagram of the developing unit. Here, black directional markers illustrated in FIG. 3 represent a rotating direction of each roller, and white directional markers in FIG. 3 represent conveying directions of the developing agent.

As illustrated in FIG. 3, the developing unit 1 includes; a developing unit housing 101 as a developing agent-containing unit containing the two-component developing agent including the toner and the carrier (two-component developing agent D); a developing sleeve 102 as a developing agent conveying unit having a magnetic roller 103 as a magnetic field generating unit having a fixed magnetic pole therein as a magnetic field generator; a layer thickness controlling unit 104 as a thickness controller which controls a layer thickness of the two-component developing agent D on the developing sleeve 102 to be a predetermined thickness and is made of a magnetic material; a receiving unit 105 which receives the two-component developing agent D and is made of a non-magnetic material; a cleaning plate 106 which cleans off the two-component developing agent D and has a magnet plate 106*a* on the back face thereof; a conveying and supplying roller 107 which supplies the two-component developing agent D to the developing sleeve 102; and a pair of agitating screws 108 and 109.

The developing sleeve 102 as a developing agent conveying unit is, for example, composed of a cylindrically shaped non-magnetic material like a stainless material having an outer diameter ranging from 8 to 60 mm. The developing sleeve 102 rotates in a direction opposite to a rotating direction of a photoreceptor drum A, in other words, in a direction indicated by the directional marker in FIG. 3 (a clockwise rotation) keeping a predetermined distance to the peripheral surface of the photoreceptor drum A (not illustrated) by butt rollers arranged at the opposite positions on the surface of the developing sleeve 102. If the outer diameter is smaller than 8 mm, it is impossible to form the magnetic roller 103 having at least five magnetic poles N1, S1, N2, S2, and N3 which are necessary for image forming. If the outer diameter is larger than 60 mm, the developing unit becomes undesirably large.

The magnetic roller 103 is encased in the developing sleeve 102. The magnetic roller 103 has a plurality of magnetic poles N3, S1, N1, S2 and N2 are circularly arranged in the order named as illustrated, and fixed concentrically with the developing sleeve 102. The magnetic roller 103 exerts magnetic force on the peripheral surface of the developing sleeve 102 which is non-magnetic.

The layer thickness controlling unit 104 as a layer thickness controller is arranged so as to face to the magnetic pole S1 of the magnetic roller 103 having a predetermined distance from the surface of the developing sleeve 102. The layer thickness controlling unit 104 is, for example, in a rod-shape or a plate-shape and made from a magnetic stainless material, and controls the layer thickness of the two-component developing agent D on the surface of the developing sleeve 102.

The receiving unit 105 is made of a non-magnetic material prepared with, for example, a resin such as ABS resin, and arranged downstream in the rotating direction of the developing sleeve 102 having a predetermined distance to the surface of the developing sleeve 102. The receiving unit 105 is adjacent to one end face of the layer thickness controlling unit 104, and fixed to the layer thickness controlling unit 104 with an adhesive agent so as to be integrated with each other. The receiving unit 105 prevents the toner from dropping from the layer of the two-component developing agent D whose thickness is controlled by the layer thickness controlling unit 104 so as to keep the layer of the two-component developing agent D stably on the peripheral surface of the developing sleeve 102. The receiving unit 105 can be formed by a part of the developing unit housing 101 and be adjacent to one end face of the layer thickness controlling unit 104.

The cleaning plate 106 which cleans off the two-component developing agent D from the developing sleeve 102 is arranged so as to face to the magnetic pole N2 of the magnetic roller 103 to remove the two-component developing agent D from the developing sleeve 102 by magnetic action which is generated by a diamagnetic field created by the magnetic poles N2 and N3 and the magnetic plate 106*a* on the back face of the cleaning plate 106.

The conveying an supplying roller 107 conveys the two-component developing agent D removed from the developing sleeve 102 by the cleaning plate 106 to the agitating screw 108, and supplies the two-component developing agent D agitated by the agitating screw 108 to the layer thickness controlling unit 104. A blade 107*a* is a blade unit equipped with the conveying and supplying roller 107 and used for conveying the two-component developing agent D.

The agitating screws 108 and 109 rotate in directions opposite to each other at the same speed, and agitate and mix the toner and the carrier which is magnetic in the developing unit 1 to make the toner of the two-component developing agent D evenly-dispersed in the two-component developing agent D.

The two-component developing agent D is supplied to the developing unit housing 101 through a two-component developing agent supplying opening 101*b* made in a top plate 101*a* of the developing unit housing 101 above the agitating screw 109, and agitated and mixed with the two-component developing agent D which had been in the developing unit housing 101 before the above supply, by the agitating screws 108 and 109 rotating in the directions opposite to each other at the same speed, to make the toner of the two-component developing agent D evenly-dispersed in the two-component developing agent D. Then, the two-component developing agent D is conveyed by the conveying and supplying roller 107 which is rotating to the layer thickness controlling unit 104. The layer thickness of the two-component developing agent D is controlled to be a predetermined thickness by the layer thickness controlling unit 104. The receiving unit 105 stabilizes the layer of the two-component developing agent D. Accordingly, the two-component developing agent D is supplied to on the peripheral surface of the developing sleeve 102.

The toner of the two-component developing agent D supplied on the peripheral surface of the developing sleeve 102 is removed therefrom and attached on the photoreceptor drum A by electrostatic attraction to correspond with an electrical latent image formed on the photoreceptor drum A.

After developing the electrical latent image on the photoreceptor drum A, the two-component developing agent D on the developing sleeve 102 is removed therefrom by magnetic action which is generated by the diamagnetic field created by the magnetic poles N2 and N3, and the magnetic plate 106*a* on the back face of the cleaning plate 106, and is conveyed by the conveying and supplying roller 107 again to the agitating screw 108. The electrical latent image on the photoreceptor drum A is reversely developed in a non-contact manner by application of a developing bias voltage of direct current (DC) bias E1 which is, as needed, superposed thereon by alternate current (AC) bias EC1, as the non-contact developing method.

The two-component developing agent D is supplied when a toner concentration detecting sensor 101*c* detects the toner concentration in the developing unit housing 101 being less than a predetermined concentration.

Here, the "toner concentration" means a proportion of the toner in the two-component developing agent D. In the toner of the two-component developing agent D in the developing unit housing 101, the toner is consumed in developing while the carrier is not consumed. Hence, the longer a developing time is, the lower the proportion of the toner in the two-component developing agent D. The toner is supplied as the toner is consumed, and the carrier is also supplied along with the toner because the two-component developing agent D includes both the toner and the carrier. The toner of the two-component developing agent D to be supplied contains the carrier in the range preferably from 10 to 30% by weight. In addition, in the present invention, the two-component developing agent D is discarded as it is used successively. Thus, the two-component developing agent D which is more than a predetermined amount is discarded from the developing unit 1.

As described above, the Auto Refining Developing System is a developing system for suppressing change in an electric charge amount and stabilizing a development density by ways of supplying the toner along with the carrier as the toner is consumed, discarding the two-component developing agent D from the developing unit 1, so as to gradually replace the two-component developing agent D with a new two-component developing agent D.

The two-component developing agent D to be supplied is supplied into the developing unit 1 from a hopper (not illustrated) as a supplying unit through the two-component developing agent supplying opening 101*b*. The two-component developing agent D supplied in the developing unit 1 is well agitated by the agitating screws 108 and 109 as described above, and the toner is charged by the agitation. Then the two-component developing agent D is conveyed and supplied to the developing sleeve 102.

The amount of the two-component developing agent D in the developing unit 101 increases as the two-component developing agent D is newly supplied. Corresponding to this increase, when a boundary level of the two-component developing agent D in the developing unit 101 becomes near a boundary corresponding to a predetermined amount of the two-component developing agent D as the two-component developing agent D is in excess, a boundary level detecting unit (not illustrated) detects an increasing state of the two-component developing agent D. Then motors of the agitating screws 108 and 109 for driving the screws are switched to reverse the rotating directions of the agitating screws 108 and 109. Thereafter, the two-component developing agent D is discarded by a discarding unit like a screw motor (not illustrated) or the like disposed in the developing unit housing 101.

The discarded two-component developing agent D is collected in a way that the discarding unit (not illustrated) starts rotating, at the same time as the agitating screw 109 starts the reverse rotation, and conveys the discarded two-component, developing agent D to a collecting container (not illustrated). The two-component developing agent D in the developing unit housing 101 is discarded as described above and the boundary level detecting unit detects decrease of the boundary level of the two-component developing agent D to a normal level, and then the agitating screws 108 and 109 stop the reverse rotation, and then restart the rotations normally.

The developing unit using the Auto Refining Developing System described above can be used in a commonly known image forming apparatus using an electrophotographic system.

Such an image forming apparatus includes, for example; a photoreceptor as an electrostatic latent image holder; a charging unit which provides an even charge on the surface of the photoreceptor by corona discharge which is homopolar with toner; an exposing unit which forms an electrostatic latent image by performing imagewise exposure on the evenly-charged surface of the photoreceptor on the basis of image data; the developing unit, using the above-mentioned Auto Refining Developing System, which conveys toner to the surface of the photoreceptor to visualize the electrostatic latent image to form a toner image; a transferring unit which transfers the toner image to a transfer material, if needed, via an intermediate transfer body; and a fixing unit which fixes the toner image on the transfer material.

Among the image forming apparatuses having the above-mentioned configuration, the Auto Refining Developing System is suitably used in a color image forming apparatus configured such that a plurality of image forming units for a plurality of photoreceptors are arranged along an intermediate transfer body, and in particular, used in a tandem-type color image forming apparatus configured such that a plurality of photoreceptors are arranged in a line over an intermediate transfer body.

In the present invention, the toner is suitably used in an image forming apparatus configured such that a fixing temperature (a surface temperature of the fixing material) is in comparatively low ranging from 100 to 200° C.

In addition, the toner of the present invention is suitably used in a high-speed image forming apparatus configured such that a linear speed of an electrostatic latent image holder ranges from 100 to 500 mm/sec.

EXAMPLES

Preparation of Core Particle

Preparation of Core Particle 1

Raw materials were weighed so as to be 35 mol % MnO, 14.5 mol % MgO, 50 mol % $Fe_2O_3$, and 0.5 mol % SrO, mixed with water, and then milled with a wet media mill for 5 hours to obtain slurry.

The obtained slurry was dried with a spray dryer to obtain spherical particles. To obtain a desired void ratio and continuous void of core particles, manganese carbonate and magnesium hydroxide are used as raw materials of MnO and MgO respectively. Particle diameters of the obtained particles were adjusted, and then a calcination of the particles was performed at 950° C. for 2 hours. Thereafter, to obtain a desired high void ratio along with a moderate fluidity of core particles, the particles were milled with a wet ball mill with stainless beads having a diameter of 0.3 cm for 1 hour followed by milling with the wet ball mill with zirconium beads having a diameter of 0.5 mm for 4 hours. A proper amount of dispersant was added to the milled slurry, and further, poly vinyl alcohol (PVA) as a binder was added to the slurry to be 0.8% by weight to the total amount of solid contents of the slurry to achieve a desired mechanical strength of the core particles and obtain a desired void ratio and continuous void of core particles. Next, the slurry was dried with a spray dryer to form particles, and the obtained particles were kept in an electric oven at 1150° C., under 0% oxygen by volume for 3.5 hours as a firing step.

Then, the particles were cracked, the cracked particles were classified to adjust particle diameters thereof, and thereafter particles having low magnetic force were segregated with a magnetic separator to obtain Core porous particles 1.

Preparation of Core Particle 2

Core porous particles 2 were prepared in the same way as the preparation of Core particle 1 except for the followings: using manganese dioxide instead of manganese carbonate; adding PVA as a binder to be 0.5% by weight; and firing at 1200° C. under 1.5% oxygen by volume for 6 hours.

Preparation of Core Particle 3

Core porous particles 3 were prepared in the same way as the preparation of Core particle 1 except for the followings: using trimanganese tetraoxide instead of manganese carbonate; and firing at 1125° C., under 0.5% oxygen by volume for 4 hours.

Preparation of Core Particle 4

Core porous particles 4 were prepared in the same way as the preparation of Core particle 1 except for the followings: using stainless beads having a diameter of 0.15 mm instead of zirconium beads having a diameter of 0.5 cm; adding PVA as a binder to be 1.0% by weight; and firing at 1100° C.

Preparation of Core Particle 5

Core porous particles 5 were prepared in the same way as the preparation of Core particle 1 except for the followings: calcinating at 1100° C. instead of at 950° C.; milling for 12 hours which follows calcinating; and firing at 1300° C. under 2.5% oxygen by volume for 2 hours.

Preparation of Core Particle 6

Core non-porous particles 6 were prepared in the same way as the preparation of Core particle 1 except for firing at 1350° C. for 6 hours.

Preparation of Ferrite Particle

Core particles 1 were milled with a ball mill to obtain ferrite particles having diameters of 0.05, 0.1, 0.3, 1, and 1.2 μm by a adjusting milling time.

Preparation of Carrier

Preparation of Carrier 1

Ingredients of Carrier 1 were: 100 parts by weight of Core particles 1; and 5 parts by weight of fine particles including 0.4 part by weight of the above-mentioned ferrite particles (0.3 μm) (added particles), which were made of finely-milled Core particle(s) 1 and used for a covering layer, and a cyclohexyl methacrylate-methyl methacrylate copolymer (a copolymerization ratio thereof is 1:1) (this copolymer had a weight-average molecular weight of 400,000 Da, a glass transition temperature of 115° C., and a particle diameter ($D_{50}$) of 100 nm). The ingredients of the carrier particles were put in a "high-speed mixing machine with agitation blades", and mixed and agitated at a low circumferential speed of 1 m/sec for 2 minutes as a pre-mixing step. Then, cold water was made to pass a jacket and the ingredients were mixed and agitated at 40° C. at a circumferential speed of 8 m/sec for 20 minutes to form intermediate carrier particles as an intermediate carrier particle forming step. Next, vapor was made to pass through the jacket, and the intermediate carrier particles were agitated at 120° C. at a circumferential speed of 8 m/sec for minutes to obtain "Carrier 1" constituted of carrier particles, as a carrier particle forming step. A carrier particle diameter was 35 μm, and a layer thickness of the resin covering layer was 1.0 μm. The layer thickness of the resin cover in layer was measured as described above.

Preparations of Carriers 2-6

Carriers 2-6 were prepared using Core particles 1 in the same way as Carrier 1 except for the ferrite particle diameters and parts by weight of the ferrite particles to be added as shown in Table 1.

Preparations of Carriers 7-11

Carriers 7-11 were prepared in the same way as Carrier 1 except for using Core particles 2-6.

Preparation of Carrier 12

Carrier 12 was prepared using Core particles 1 in the same way as Carrier 1 except for using magnetite "BL-10" (Titan Kogyo Ltd.) instead of ferrite particles.

Preparation of Carrier 13

Carrier 13 was prepared using Core particles 1 in the same way as Carrier 1 except for using carbon black "MOGUL L" (Cabot Corporation) instead of the ferrite particles.

Preparation of Carrier 14

Carrier 14 was prepared using Core particles 1 in the same way as Carrier 1 except for adding no ferrite particle.

Preparations of Carriers 15 and 16

Carriers 15 and 16 were prepared using Core particles 1 in the same way as Carrier 1 except for the ferrite particle diameters and parts by weight of the ferrite particles to be added as shown in Table 1.

TABLE 1

| CARRIER | CORE PARTICLE | | ADDED | CARRIER PARTICLE | BULK DENSITY |
|---|---|---|---|---|---|
| NO. | NO. | COMPOSITION | PARTICLE | DIAMETER [μm] | [g/cm³] |
| CARRIER 1 | CORE PARTICLE 1 | POROUS FERRITE PARTICLE | FERRITE | 35 | 1.73 |
| CARRIER 2 | CORE PARTICLE 1 | POROUS FERRITE PARTICLE | FERRITE | 35 | 1.72 |
| CARRIER 3 | CORE PARTICLE 1 | POROUS FERRITE PARTICLE | FERRITE | 35 | 1.74 |
| CARRIER 4 | CORE PARTICLE 1 | POROUS FERRITE PARTICLE | FERRITE | 35 | 1.75 |
| CARRIER 5 | CORE PARTICLE 1 | POROUS FERRITE PARTICLE | FERRITE | 35 | 1.73 |
| CARRIER 6 | CORE PARTICLE 1 | POROUS FERRITE PARTICLE | FERRITE | 35 | 1.73 |
| CARRIER 7 | CORE PARTICLE 2 | POROUS FERRITE PARTICLE | FERRITE | 35 | 1.93 |
| CARRIER 8 | CORE PARTICLE 3 | POROUS FERRITE PARTICLE | FERRITE | 35 | 1.31 |
| CARRIER 9 | CORE PARTICLE 4 | POROUS FERRITE PARTICLE | FERRITE | 35 | 1.03 |
| CARRIER 10 | CORE PARTICLE 5 | POROUS FERRITE PARTICLE | FERRITE | 35 | 2.03 |
| CARRIER 11 | CORE PARTICLE 6 | FERRITE PARTICLE | FERRITE | 35 | 2.15 |
| CARRIER 12 | CORE PARTICLE 1 | POROUS FERRITE PARTICLE | MAGNETITE | 35 | 1.73 |
| CARRIER 13 | CORE PARTICLE 1 | POROUS FERRITE PARTICLE | CARBON BLACK | 35 | 1.72 |
| CARRIER 14 | CORE PARTICLE 1 | POROUS FERRITE PARTICLE | — | 35 | 1.72 |

TABLE 1-continued

| | | | | | |
|---|---|---|---|---|---|
| CARRIER 15 | CORE PARTICLE 1 | POROUS FERRITE PARTICLE | FERRITE | 35 | 1.72 |
| CARRIER 16 | CORE PARTICLE 1 | POROUS FERRITE PARTICLE | FERRITE | 35 | 1.72 |

| CARRIER NO. | ADDED PARTICLE DIAMETER [μm] | AMOUNT OF ADDED PARTICLE [PARTS BY WEIGHT] | AMOUNT OF COVERING RESIN [PARTS BY WEIGHT] | AVERAGE LAYER THICKNESS [μm] |
|---|---|---|---|---|
| CARRIER 1 | 0.3 | 0.4 | 5 | 1.0 |
| CARRIER 2 | 0.3 | 0.05 | 5 | 1.0 |
| CARRIER 3 | 0.3 | 1 | 5 | 1.0 |
| CARRIER 4 | 0.3 | 1.2 | 5 | 1.0 |
| CARRIER 5 | 0.1 | 0.4 | 5 | 1.0 |
| CARRIER 6 | 1 | 0.4 | 5 | 1.0 |
| CARRIER 7 | 0.3 | 0.4 | 4.4 | 1.0 |
| CARRIER 8 | 0.3 | 0.4 | 6.5 | 1.0 |
| CARRIER 9 | 0.3 | 0.4 | 8.3 | 1.0 |
| CARRIER 10 | 0.3 | 0.4 | 4.2 | 1.0 |
| CARRIER 11 | 0.3 | 0.4 | 3.6 | 1.0 |
| CARRIER 12 | 0.3 | 0.4 | 5 | 1.0 |
| CARRIER 13 | 0.03 | 0.4 | 5 | 1.0 |
| CARRIER 14 | — | 0 | 5 | 1.0 |
| CARRIER 15 | 0.05 | 0.4 | 5 | 1.0 |
| CARRIER 16 | 1.2 | 0.4 | 5 | 1.0 |

Provided was "Cyan toner" used for "bizhub C360" (Konica Minolta business technologies, Inc).

Preparation of Two-Component Developing Agent

Carriers 1-16 were mixed with the cyan toner as follows to prepare two-component developing agents 1-10 as Examples 1-10, and two-component developing agent 11-16 as Comparative Examples 1-6.

Toner amounts to the Carriers 1-16 are shown in Table 2, when each of Carriers 1-16 was 100 parts by weight. The toner and each of the Carriers 1-16 were mixed with a V blender at room temperature under a normal humidity (at 20° C. under 50% relative humidity (RH)). A rotation speed of the V blender was 20 rpm, and an agitating time was 20 minutes. The prepared mixes were screened with a screen having an aperture of 125 μm to prepare the two-component developing agents 1-16.

[Evaluation]

Each of the prepared two-component developing agents 1-16 was put one by one in the following apparatus as an image evaluating apparatus, and printing was performed for the evaluation as described below.

As the image evaluating apparatus, a modified digital color multi-functional peripheral "bizhub C360" was used. Each of the prepared two-component developing agents 1-16 was put one by one in the image evaluating apparatus, and a printing of 200.000 copies was performed at 20° C. under 50% RH for each of the prepared two-component developing agents 1-16. An image for the printing had a 1% pixel ratio (an original image equally divided into a 7% text image, a face image, a solid white image, and a solid black image) and was printed on fine paper A4 (64 g/m$^2$). "Double circle (◎)" and "single circle (○)" in Table 2 mean that the two-component developing agent concerned was acceptable.

<Transfer Rate>

In the early period of and after the printing of 200,000 copies, a solid image (20 mm×50 mm) having an image density of 1.30 was printed. The transfer rate of this image, which was obtained according to the following equation, was evaluated.

Transfer rate (%)=(weight of the toner transferred on the transfer material/weight of the toner developed on the photoreceptor)×100

An acceptable transfer rate was 85% or more.

<Carrier Adhesion>

Carrier adhesion was evaluated as follows. After the printing of 200,000 copies of a text image having a 5% coverage rate at room temperature under a normal humidity (at 20° C. under 50% relative humidity (RH)), a solid image (50 mm×50 mm) was printed. The number of the carrier particles of the carriers 1-16 adhered on the solid image was obtained by visual check with a magnifying glass. An acceptable number of the adhering carrier particles is 10 or less.

<Edge Effect>

In the early period of the printing, printed was an image consisting of a half-tone image having an image density of 0.5 and a solid image which had an image density of 1.2 to 1.3 and was arranged downstream of the half-tone image in a printing direction. This image was evaluated in that whether white splotches were formed in the half-tone image around the borderline between the solid image and the half-tone image.

<<Evaluation Criteria>>

"Double circle (◎)": No white splotch was formed in the half-tone image.

"Single circle (○)": Although no white splotch was formed in the half-tone image, an image density thereof was a little reduced.

"Cross (x)": White splotches were formed.

<Density Unevenness>

In the early period of and after the printing of 200,000 copies, a solid image was printed. This solid image was evaluated in that whether density unevenness (ghost) was generated in the solid image according to the following criteria.

Here, "ghost" is a name of a phenomenon that an image density gradually becomes lower because of insufficient replacement of a developing agent on a developing sleeve.

<<Evaluation Criteria>>

"Double circle (◎)": No density unevenness was generated in the solid image.

"Single circle (○)": Minimal density unevenness was generated in the solid image (not problematic for actual use)

"Cross (x)": Density unevenness was generated in the solid image (problematic for actual use).

<Stain on Image>

After the printing of 200,000 copies, a solid image was printed. Whether or not stain was generated on the image was evaluated according to the following criteria.

<<Evaluation Criteria>>

"Double circle (◎)": no stain was generated on the solid image.

"Single circle (○)": black splotches were slightly generated on the solid image (not problematic for actual use)

"Cross (x)": black splotches were clearly generated on the solid image.

covering layer which covers the surface of the porous ferrite core particle. The resin covering layer includes the ferrite particles, and the average particle diameter of the ferrite particles ranges from 0.1 to 1.0 μm.

According to the present invention, a specific gravity of the carrier can be lowered, and hence agitation stress to the toner lower can be lowered. Accordingly, an external additive can be prevented from being embedded and decrease of a transfer rate can be suppressed.

Further, because the ferrite particles having magnetization are included in the resin covering layer as an electric resistance controlling material for the carrier, the carrier can get a low electric resistance, a developability can be enhanced, and the edge effect can be reduced.

Still further, since a conventional electric resistance controlling material like carbon black does not have magnetization, when removed from the carrier, such a material develops an image on a photoreceptor transformed from a developing sleeve, and stains an image in the end. On the contrary, in the present invention, because the ferrite particles having magnetization is used, even if the ferrite particles are removed from the carrier, the ferrite particles are taken by magnetic force onto a developing sleeve, and do not develop an image but remains on a developing unit, and thus do not stain images.

TABLE 2

| | TWO-COMPONENT DEVELOPING AGENT NO. | CARRIER NO. | AMOUNT OF TONER/ PARTS BY WEIGHT | TRANSFER RATE | CARRIER ADHESION | EDGE EFFECT | DENSITY UNEVENNESS | STAIN |
|---|---|---|---|---|---|---|---|---|
| EXAMPLE 1 | TWO-COMPONENT DEVELOPING AGENT 1 | CARRIER 1 | 8.0 | 96 | 0 | ◎ | ◎ | ◎ |
| EXAMPLE 2 | TWO-COMPONENT DEVELOPING AGENT 2 | CARRIER 2 | 8.0 | 95 | 0 | ○ | ◎ | ◎ |
| EXAMPLE 3 | TWO-COMPONENT DEVELOPING AGENT 3 | CARRIER 3 | 8.0 | 96 | 0 | ◎ | ◎ | ◎ |
| EXAMPLE 4 | TWO-COMPONENT DEVELOPING AGENT 4 | CARRIER 4 | 8.0 | 96 | 0 | ◎ | ◎ | ◎ |
| EXAMPLE 5 | TWO-COMPONENT DEVELOPING AGENT 5 | CARRIER 5 | 8.0 | 96 | 0 | ◎ | ◎ | ○ |
| EXAMPLE 6 | TWO-COMPONENT DEVELOPING AGENT 6 | CARRIER 6 | 8.0 | 96 | 0 | ○ | ◎ | ◎ |
| EXAMPLE 7 | TWO-COMPONENT DEVELOPING AGENT 7 | CARRIER 7 | 7.1 | 92 | 0 | ◎ | ◎ | ◎ |
| EXAMPLE 8 | TWO-COMPONENT DEVELOPING AGENT 8 | CARRIER 8 | 10.5 | 97 | 2 | ◎ | ◎ | ◎ |
| EXAMPLE 9 | TWO-COMPONENT DEVELOPING AGENT 9 | CARRIER 9 | 13.0 | 97 | 9 | ◎ | ◎ | ◎ |
| EXAMPLE 10 | TWO-COMPONENT DEVELOPING AGENT 10 | CARRIER 10 | 6.8 | 86 | 0 | ○ | ◎ | ◎ |
| COMPARATIVE EXAMPLE 1 | TWO-COMPONENT DEVELOPING AGENT 11 | CARRIER 11 | 6.4 | 80 | 0 | ○ | ◎ | ◎ |
| COMPARATIVE EXAMPLE 2 | TWO-COMPONENT DEVELOPING AGENT 12 | CARRIER 12 | 8.0 | 96 | 0 | ◎ | X | ◎ |
| COMPARATIVE EXAMPLE 3 | TWO-COMPONENT DEVELOPING AGENT 13 | CARRIER 13 | 8.0 | 96 | 0 | ◎ | ◎ | X |
| COMPARATIVE EXAMPLE 4 | TWO-COMPONENT DEVELOPING AGENT 14 | CARRIER 14 | 8.0 | 96 | 0 | X | ◎ | ◎ |
| COMPARATIVE EXAMPLE 5 | TWO-COMPONENT DEVELOPING AGENT 15 | CARRIER 15 | 8.0 | 96 | 0 | ◎ | ◎ | X |
| COMPARATIVE EXAMPLE 6 | TWO-COMPONENT DEVELOPING AGENT 16 | CARRIER 16 | 8.0 | 96 | 0 | X | ◎ | ◎ |

As shown by data in Table 2, the two-component developing agents of Examples 1-10 had more preferable properties of a transfer rate, an edge effect, a density unevenness, and stain on image, than the developing agents of Comparative Examples 1-6.

As described above, the two-component development D of the present invention includes the toner including a biding resin and the carrier including the carrier particles, each of which includes the porous ferrite core particle and the resin Moreover, although conventionally used magnetite having magnetization does not stain images, since magnetite has a high residual magnetization and thus decreases a fluidity of a carrier, magnetite causes an insufficient replacement of a developing agent on a developing sleeve and an insufficient mixing of a carrier and toner. On the contrary, the ferrite particles of the present invention have a low residual magnetization, and thus do not cause the above-mentioned problems and provide a desirable fluidity.

As described above, the present invention stably provides high quality images.

The entire disclosure of Japanese Patent Application No. 2011-287318 filed on Dec. 28, 2011 in the Japanese Patent Office including the description, claims, drawings and abstract is incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A two-component developing agent comprising:

toner including a binding resin; and a carrier including carrier particles, each of which includes a porous ferrite core particle and a resin covering layer which covers the surface of the porous ferrite core particle;

the resin covering layer including ferrite particles; wherein an average particle diameter of the ferrite particles ranges from 0.1 to 1.0 μm.

2. The two-component developing agent of claim 1, wherein a bulk density of the carrier particles ranges from 1.1 to 2.0 g/cm$^3$.

3. The two-component developing agent of claim 1, wherein a bulk density of the carrier particles ranges from 1.3 to 1.8 g/cm$^3$.

4. The two-component developing agent of claim 1, wherein the two component developing agent includes from 0.01 to 1 part by weight of the ferrite particles to the porous ferrite core particle.

5. The two-component developing agent of claim 1, wherein the two component developing agent includes 0.1 to 0.8 part by weight of the ferrite particles to the porous ferrite core particle.

6. The two-component developing agent of claim 1, wherein an average layer thickness of the resin covering layer ranges from 0.05 to 4 μm.

7. The two-component developing agent of claim 1, wherein the porous ferrite core particle includes manganese (Mn).

8. The two-component developing agent of claim 1, wherein the porous ferrite core particle includes magnesium (Mg).

9. The two-component developing agent of claim 1, wherein the porous ferrite core particle includes manganese (Mn) and magnesium (Mg).

10. The two-component developing agent of claim 1, wherein a composition of the ferrite particle is identical to a composition of the porous ferrite core particle.

11. The two-component developing agent of claim 1, wherein the average particle diameter of the ferrite particles ranges from 0.2 to 0.8 μm.

12. The two-component developing agent of claim 1, wherein the resin covering layer is constituted of an acrylic resin.

13. The two-component developing agent of claim 12, wherein the acrylic resin is a copolymer of an alicyclic methacrylic ester monomer and a chain methacrylic ester monomer.

14. The two-component developing agent of claim 13, wherein a copolymerization proportion of the chain methacrylic ester monomer in the copolymer ranges from 10 to 70% by weight.

15. The two-component developing agent of claim 1, wherein the resin covering layer of the carrier particle is prepared by a dry coating method.

16. A developing method comprising performing development with the two-component developing agent of claim 1 so as to supply the toner and the carrier together.

* * * * *